US009832574B2

(12) United States Patent
Rosenkranz et al.

(10) Patent No.: US 9,832,574 B2
(45) Date of Patent: Nov. 28, 2017

(54) METHOD AND APPARATUS FOR FEEDBACK SUPPRESSION

(71) Applicant: SIVANTOS PTE. LTD., Singapore (SG)

(72) Inventors: Tobias Daniel Rosenkranz, Erlangen (DE); Tobias Wurzbacher, Fuerth (DE)

(73) Assignee: Sivantos Pte. Ltd., Singapore (SG)

( * ) Notice: Subject to any disclaimer, the term of this patent is extended or adjusted under 35 U.S.C. 154(b) by 56 days.

(21) Appl. No.: 14/856,793

(22) Filed: Sep. 17, 2015

(65) Prior Publication Data

US 2016/0080875 A1 Mar. 17, 2016

(30) Foreign Application Priority Data

Sep. 17, 2014 (DE) ..... 10 2014 218 672

(51) Int. Cl.
*H04R 25/00* (2006.01)

(52) U.S. Cl.
CPC ..... *H04R 25/453* (2013.01)

(58) Field of Classification Search
CPC ..... G10K 11/178; H04R 1/1083; H04R 25/70
See application file for complete search history.

(56) References Cited

U.S. PATENT DOCUMENTS 5,442,268 A * 8/1995 Goodarzi ..... B60L 11/1803 318/432
8,019,105 B2 * 9/2011 Kates ..... H04R 25/356 381/106
2004/0109578 A1 * 6/2004 Niederdrank ..... H04R 25/453 381/318
2008/0273728 A1 * 11/2008 Klinkby ..... H04R 25/453 381/318
2010/0020996 A1 * 1/2010 Elmedyb ..... H04R 25/453 381/318
2010/0027805 A1 * 2/2010 Itou ..... G10K 11/178 381/71.12
2010/0296680 A1 11/2010 Korl et al.
2011/0033073 A1 * 2/2011 Inoshita ..... H04R 25/552 381/323
2013/0294610 A1 11/2013 Munk
2015/0071454 A1 3/2015 Sunohara et al.
2015/0124976 A1 * 5/2015 Pedersen ..... H04R 25/552 381/23.1

(Continued)

FOREIGN PATENT DOCUMENTS

DE 602004006912 T2 2/2008
EP 2203000 A1 6/2010

(Continued)

*Primary Examiner* — Md S Elahee
*Assistant Examiner* — Angelica M McKinney
(74) *Attorney, Agent, or Firm* — Laurence A. Greenberg; Werner H. Stemer; Ralph E. Locher

(57) ABSTRACT

A method and apparatus reduce feedback in a hearing aid. The method involves a first transfer function, which includes a feedback path, being estimated for a first section of a signal response. A power of a feedback signal from a second transfer function of the feedback path is estimated for a second section of the signal response, and a parameter of the signal processing device and/or of the feedback suppression unit is adjusted on the basis of the estimated power.

14 Claims, 3 Drawing Sheets

(56) References Cited

U.S. PATENT DOCUMENTS

| | | | | |
|---|---|---|---|---|
| 2016/0057548 | A1* | 2/2016 | Wurzbacher ..... | H04R 25/45<br>381/315 |

FOREIGN PATENT DOCUMENTS

| | | | |
|---|---|---|---|
| EP | 2661103 | A1 | 11/2013 |
| JP | 5588054 | B1 | 9/2014 |
| WO | 2008065209 | A2 | 6/2008 |

* cited by examiner

METHOD AND APPARATUS FOR FEEDBACK SUPPRESSION

CROSS-REFERENCE TO RELATED APPLICATION

This application claims the priority, under 35 U.S.C. §119, of German application DE 10 2014 218 672.2, filed Sep. 17, 2014; the prior application is herewith incorporated by reference in its entirety.

BACKGROUND OF THE INVENTION

Field of the Invention

The invention relates to a hearing aid, wherein the hearing aid has an acoustoelectric transducer, a signal processing device, a feedback suppression unit and an electroacoustic transducer.

Hearing aids are portable hearing apparatuses that are used to look after people with impaired hearing. In order to meet the numerous individual needs, different designs of hearing aids are provided, such as behind-the-ear (BTE) hearing aids, a hearing aid with an external receiver (RIC: receiver in the channel) and in-the-ear (ITE) hearing aids, e.g. including concha hearing aids or channel hearing aids (ITE, CIC). The hearing aids listed by way of example are worn on the outer ear or in the auditory canal. Furthermore, there are also bone conduction hearing aids, implantable or vibrotactile hearing aids available on the market, however. These involve the damaged hearing being stimulated either mechanically or electrically.

Hearing aids basically have the essential components of an input transducer, an amplifier and an output transducer. The input transducer is normally an acoustoelectric transducer, e.g. a microphone, and/or an electromagnetic receiver, e.g. an induction coil. The output transducer is generally in the form of an electroacoustic transducer, e.g. a miniature loudspeaker, or in the form of an electromechanical transducer, e.g. a bone conduction receiver. The amplifier is usually integrated in a signal processing device. The power supply is usually provided by a battery or a rechargeable storage battery.

Owing to the immediate proximity of the microphone to the loudspeaker or receiver and a high gain in order to compensate for diminished hearing capability, hearing aids run the risk of acoustic feedback, which is manifested as annoying whistling for the wearer.

U.S. patent publication No. 2008/0273728 A1 discloses a hearing aid that has an adaptive filter for producing a feedback suppression signal and an estimation apparatus for estimating an upper gain limit.

The implementation of adaptive filters is limited, since filters having a long length, i.e. filters that also consider heavily delayed signals, have long delay times and require memory space for buffer-storing samples and coefficients. Therefore, the feedback suppression by adaptive filters in the prior art is limited to signals with a short propagation time on the feedback path.

SUMMARY OF THE INVENTION

It is therefore the object of the present invention to provide a hearing aid and a method for operating the hearing aid that is capable of suppressing feedback even under difficult conditions.

The method according to the invention reduces feedback in a hearing aid, wherein the hearing aid has an acoustoelectric transducer, a signal processing device, a feedback suppression unit and an electroacoustic transducer.

The method includes a step of estimating a first transfer function, which contains a feedback path via the electroacoustic transducer, an acoustic signal path from the electroacoustic transducer to the acoustoelectric transducer and via the acoustoelectric transducer back to the signal processing device and a transfer function provided by the signal processing device. The estimation is performed for a first section of a signal response. In this case, the signal response denotes a series of values or coefficients that describe a response by the first transfer function to excitation or to a signal. An ordinal number in the series of values corresponds, for example via the sampling rate, to a time that has elapsed between excitation and sampling of the value in the series with the corresponding ordinal number.

The method according to the invention additionally has the step of estimating a power of a feedback signal from a second transfer function of the feedback path for a second section of the signal response, wherein the first section and the second section are disjunct or overlap only partially and the second section is secondary to the first section in respect of a propagation time. By way of example, the signal response for the series of values is described by a first and a second transfer function that represent different sections of the series and hence different intervals of time for the series values and the corresponding transfer function values from the signal excitation. The first transfer function is therefore defined for an earlier time period in the signal response of the feedback path than the second transfer function.

The method according to the invention has a step of adjusting a parameter of the signal processing device and/or of the feedback suppression unit on the basis of the estimated power. Exemplary parameters are stated in the sub claims. The dependency of the parameter value may be an arbitrary dependency, for example a proportional, square, exponential, logarithmic or other functional dependency, for example including a binary one, i.e. above a threshold value for the estimated power a parameter is set from true to false or vice versa and hence a functionality of the signal processing or of the feedback suppression is activated or deactivated.

Advantageously, the method according to the invention allows even a second section of a signal response, which corresponds to a longer signal delay, to be considered when adjusting the signal processing or feedback device, and in this way allows feedback to be prevented even under adverse conditions.

The hearing aid according to the invention shares the advantages of the method according to the invention.

Further advantageous developments of the invention are specified in the dependent claims.

In one conceivable embodiment of the method according to the invention, the method additionally has the step of taking the first transfer function as a basis for extrapolating the second transfer function.

The first transfer function is estimated in accordance with the method. In this case, the estimation is performed, for example, by adaptive filters that model the function to be estimated by parameterized mathematical functions. This involves the parameters being matched to incoming signals such that a discrepancy between the modeled transfer function and the real signals is minimized (e.g. least mean square LMS, NMLS etc.). Such methods require memory and processor power to an increasing extent as the length and number of coefficients increase. Since the second transfer function is extrapolated from the first transfer function, there is a much lower resource requirement for greater lengths. By way of example, the first transfer function can be continued using a modeled attenuation constant.

In one conceivable embodiment of the method according to the invention, the power of the second section of the feedback signal is determined by the second transfer function. This also allows the resource requirement for estimating the power to be advantageously reduced.

In one conceivable embodiment, the adjusted parameter indicates an adaptive compensation filter component. In order to suppress feedback, it is possible to appraise the feedback signal, for example by the adaptive filters already presented above, and to subtract the estimated feedback signal from the input signal, so that given ideal, precise estimation the two signals cancel one another out. In the proposed embodiment, at least one parameter of the adaptive filter is ascertained not directly through adaptive matching to the input signal but rather on the basis of the estimated power, allowing simpler computation.

In one possible embodiment of the method according to the invention, the parameter influences a gain of a signal between the acoustoelectric transducer and the electroacoustic transducer in the signal processing device.

A further advantageous way of suppressing feedback is to alter the gain in the hearing aid, so that the total gain becomes less than 1.

In one conceivable embodiment of the method according to the invention, in the step of adjustment the gain is decreased by a value on the basis of the estimated power or is limited to a value on the basis of the estimated power.

If feedback noise has already occurred and is evident from the estimated power in the second section, it is advantageously possible to suppress the feedback noise by reducing the gain, for example as power increases or when a threshold value is exceeded. If noise has not yet occurred but can be expected, for example on account of growing power in the second section of the feedback signal, limitation of the gain can prevent the feedback from occurring.

In one conceivable embodiment of the method according to the invention, a respective parameter is adjusted in at least two of a plurality of disjunct or only partially overlapping frequency ranges. To this end, it is preferably possible for the other steps of the method also each to be carried out separately for one or more of the frequency bands.

In hearing aids, it is customary to split an input signal into a plurality of frequency bands in order to provide a frequency-dependent gain for the frequency-dependent compensation for a hearing loss. The method according to the invention uses this advantageously by adjusting a parameter in each of the individual frequency bands. By way of example, feedback whistling preferably occurs in a narrowly limited frequency range, so that the feedback can be suppressed by a reduction in this frequency range only, without reducing the gain in other frequency ranges.

Other features which are considered as characteristic for the invention are set forth in the appended claims.

Although the invention is illustrated and described herein as embodied in a method and an apparatus for feedback suppression, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
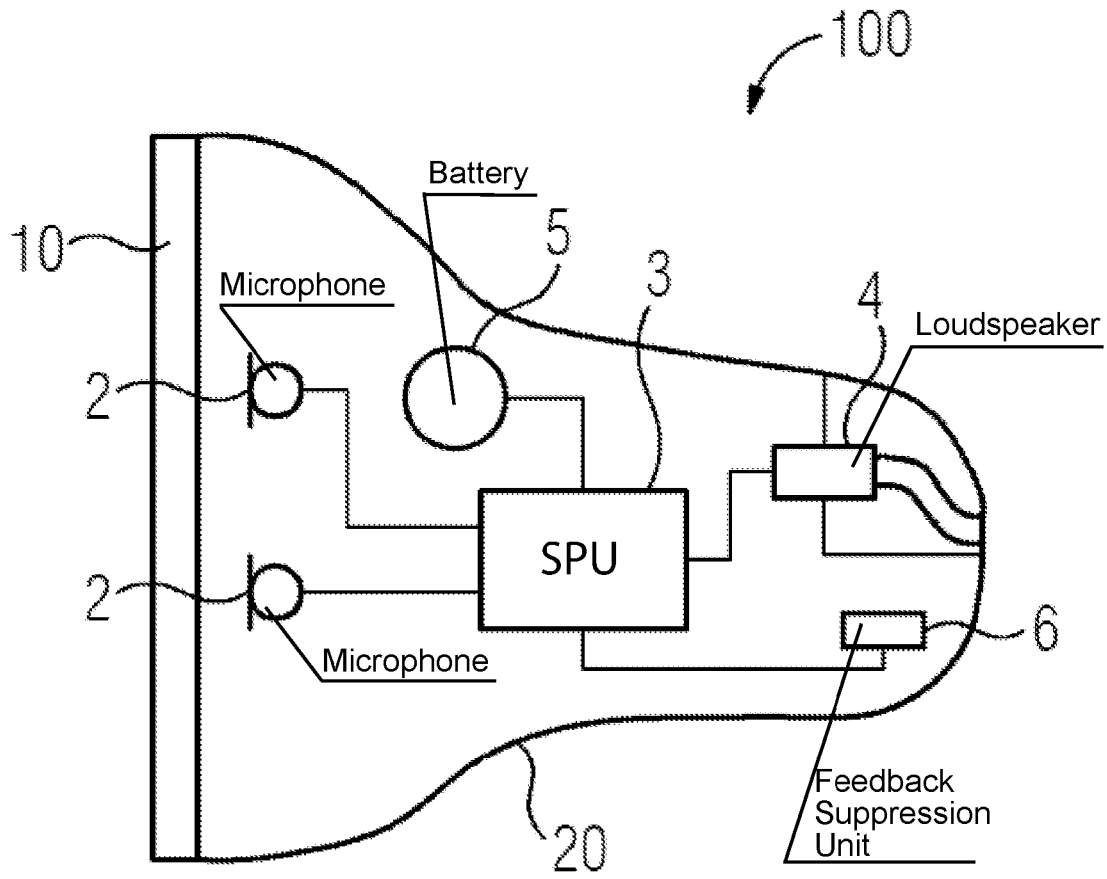
FIG. 1 is an exemplary schematic illustration of a hearing aid according to the invention.

Referring now to the figures of the drawings in detail and first, particularly to FIG. 1 thereof, there is shown a basic design of a hearing aid 100 according to the invention. A hearing aid housing 10, 20 incorporates one or more microphones, also called acoustoelectric transducers 2, for picking up the sound or audible signals from the environment. The invention is not limited to the in-the-ear hearing aid (ITE) shown, however, but rather can equally be used in behind-the-ear (BTE) or completely-in-canal (CIC) hearing aids. The microphones are acoustoelectric transducers 2 for converting the sound into first electrical audio signals. A signal processing device 3, which is likewise arranged in the hearing aid housing 10, 20, processes the first audio signals. The output signal from the signal processing device 3 is transmitted to a loudspeaker or receiver 4 that outputs an audible signal. The sound is transmitted to the eardrum of the device wearer, possibly via a sound tube that is fixed in the auditory canal with an ear mold. Alternatively, a different electromechanical transducer is conceivable, such as a bone conduction receiver. The power supply for the hearing aid and particularly that for the signal processing device 3 are provided by a battery 5 that is likewise integrated in the hearing aid housing 1.

Figure 2:
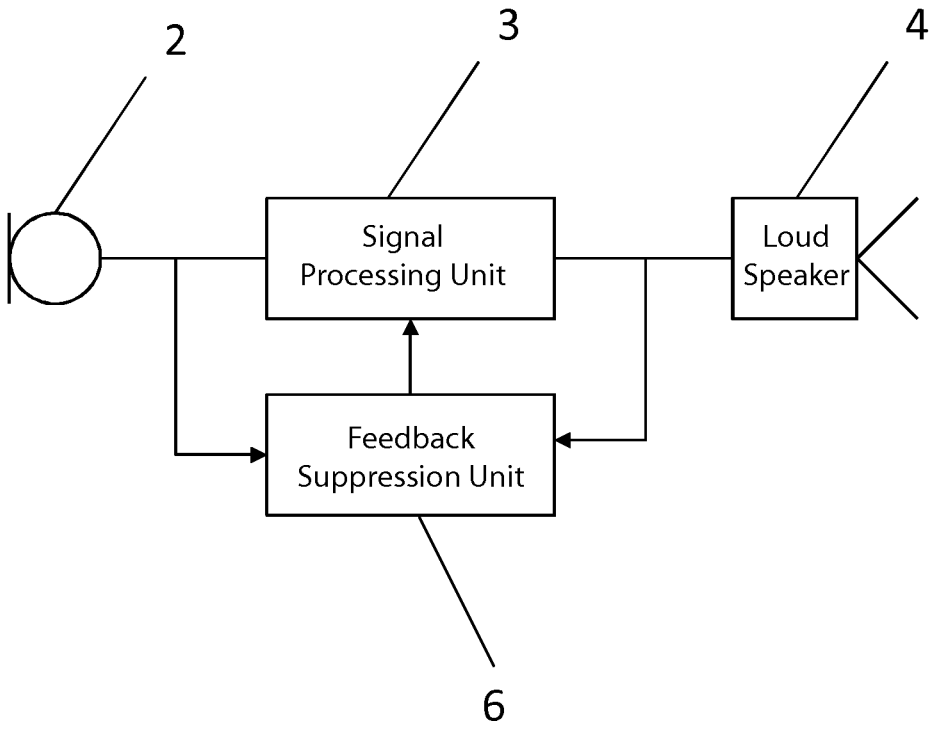
FIG. 2 is a schematic flowchart for discussing a method according to the invention.

FIG. 2 shows the signal processing of an exemplary hearing aid 100 according to the invention as a block diagram. The hearing aid 100 has a feedback suppression unit 6 according to the invention. This has a signal connection to the signal processing device 3 in order to capture information about an audible signal picked up by the microphone 2 and a signal that is output to the receiver 4. Furthermore, the feedback suppression unit 6 is capable of using a signal connection to influence the signal processing device 3, for example to alter the gain.

In this case, it is likewise conceivable for the function of the feedback suppression unit 6 to be implemented in the signal processing device 3 itself, for example as circuits in an ASIC or as a function block in the signal processing unit.

Figure 3:
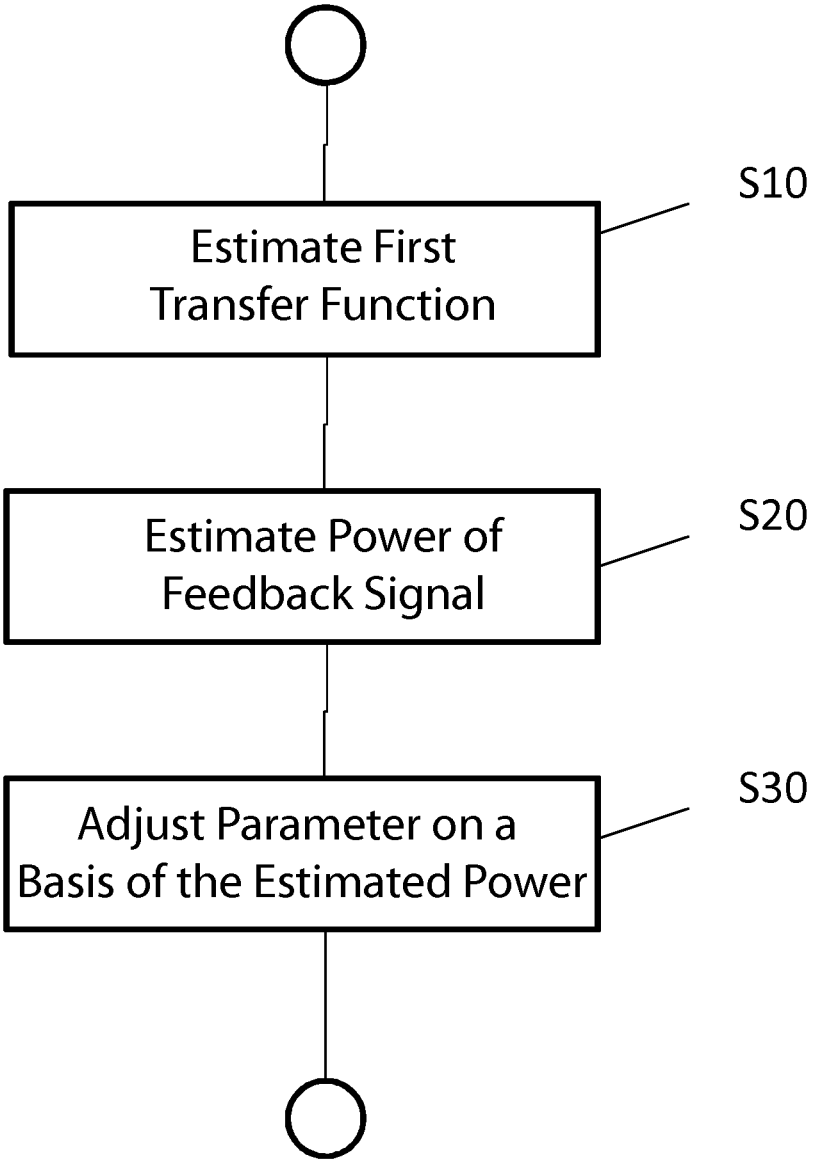
FIG. 3 is a schematic illustration in function blocks for a possible implementation of a hearing aid according to the invention.

FIG. 3 shows a schematic flowchart for a method according to the invention.

In a step S10, the hearing aid 100 estimates a first transfer function that includes a feedback path via the electroacoustic transducer 4, an acoustic signal path from the electroacoustic transducer to the acoustoelectric transducer 2 and via the acoustoelectric transducer 2 back to the signal processing device 3 and a transfer function provided by the signal processing device 3.

The estimation can be performed using an adaptive filter, for example, in which the transfer function is modeled by a parameterized function and the parameters of the transfer function are approximated using an approximation method, so that a discrepancy between the real signals that are picked up by the acoustoelectric transducer 2 or are output by the acoustoelectric transducer 4 and the signals ascertained using the parameterized function is minimized.

Popular methods in this regard are least mean square (LMS or also NMLS). The transfer function of the signal processing 3 can also be ascertained from internal parameters of the signal processing 3 directly without approximation methods. This is particularly simple when the feedback suppression unit 6 is integrated in the signal processing 3.

The estimation methods, such as LMS, accomplish this by processing a limited number of samples of the audio signals so as first to limit the signal delay, since an estimate cannot be computed until the samples are available in the memory, of course. Second, the need for computation power also increases, since the number of computation operations also rises with the number of samples. Therefore, in step 10, the estimation is performed only for a first section of a signal response with N samples, where N can be equal to a number of 10, 20, 50, 100, 500 or also intermediate powers of two, for example.

In a step S20, a power of a feedback signal from a second transfer function of the feedback path is estimated for a second section of the signal response, the first section and the second section being disjunct or overlapping only partially and the second section being secondary to the first section in respect of a propagation time. As already explained in relation to S10, the estimation of a signal response is in reality limited to a length of a filter that has previously been denoted by the variable N. From N samples, it is possible to determine a maximum of N mutually independent parameters. Under adverse conditions, e.g. in the case of an environment with high reflection and low attenuation, it is alternatively possible for signals that are delayed by more than N samples to have significant acoustic power and to result in feedback. In order to ensure stable operation of the hearing aid 100, it may therefore be necessary to estimate a power of the signal response also in a second section of the signal response that adjoins the first section, partially overlaps it, but is essentially disjunct or even follows it at an interval of time.

In one conceivable embodiment, this is accomplished by extrapolating the first estimated transfer function. A conceivable model in this case is that an attenuation is existent and the first transfer function is continued with an exponential drop and the power for the second section ascertained in this manner is estimated by forming square sums for extrapolated samples, for example.

Alternatively, it is possible for the determined power at the end of the first section to be taken as an output value directly and for the power to be allowed to drop exponentially.

Many other methods are conceivable that make different physical assumptions or are optimized in terms of the computation in order to estimate the power of the second section.

In a step S30, a parameter of the signal processing device and/or of the feedback suppression unit is adjusted on the basis of the estimated power.

If the power estimated in step S20 exceeds a threshold value, for example, a gain can be reduced or provided with a limit in the signal processing device. Conversely, it is also conceivable for the gain to be increased again when the estimated power falls below a threshold value.

Alternatively, it is conceivable for one or more weighting factors for parameters of the adaptive filter, for example, to be raised or lowered in the feedback suppression unit 6.

Although the invention has been illustrated and described in more detail by means of the preferred exemplary embodiment, the invention is not restricted by the disclosed examples and other variations can be derived therefrom by a person skilled in the art without departing from the scope of protection of the invention.

The invention claimed is:

1. A method for reducing feedback in a hearing aid having an acoustoelectric transducer, a signal processing device, a feedback suppression unit and an electroacoustic transducer, which method comprises the steps of:

estimating a first transfer function, which includes a feedback path via the electroacoustic transducer, an acoustic signal path from the electroacoustic transducer to the acoustoelectric transducer and via the acoustoelectric transducer back to the signal processing device and a transfer function provided by the signal processing device, for a first section of a signal response;

estimating a power of a feedback signal from a second transfer function of the feedback path for a second section of the signal response, wherein the first section and the second section are disjunct or overlap only partially and the second section is secondary to the first section in respect of a propagation time, so that the first transfer function is therefore defined for an earlier time period in the signal response of the feedback path than the second transfer function and so that the second section of the signal response corresponds to a longer signal delay; and adjusting a parameter of at least one of the signal processing device or a feedback suppression unit on a basis of the power estimated.

2. The method according to claim 1, which further comprises taking the first transfer function as a basis for extrapolating the second transfer function.

3. The method according to claim 2, which further comprises determining the power of the second section of the feedback signal by means of the second transfer function.

4. The method according to claim 1, wherein the parameter adjusted indicates an adaptive compensation filter component.

5. The method according to claim 1, wherein the parameter influences a gain of a signal between the acoustoelectric transducer and the electroacoustic transducer in the signal processing device.

6. The method according to claim 4, wherein in the adjusting step, decreasing a gain by a value on a basis of the power estimated or is limited to a value on the basis of the power estimated.

7. The method according to claim 1, which further comprises adjusting a respective parameter in at least two of a plurality of disjunct or only partially overlapping frequency ranges.

8. A hearing aid, comprising:

an acoustoelectric transducer;

a signal processing device;

a feedback suppression unit;

an electroacoustic transducer; and a controller configured to:

estimate a first transfer function, which includes a feedback path via said electroacoustic transducer, an acoustic signal path from said electroacoustic transducer to said acoustoelectric transducer and via said acoustoelectric transducer back to said signal processing device and a transfer function provided by said signal processing device, for a first section of a signal response;

estimate a power of a feedback signal from a second transfer function of said feedback path for a second section of the signal response, wherein the first section and the second section are disjunct or overlap only partially and the second section is secondary to the first section in respect of a propagation time, so that the first transfer function is therefore defined for an earlier time period in the signal response of the feedback path than the second transfer function and so that the second section of the signal response corresponds to a longer signal delay; and adjust a parameter of at least one of said signal processing device or of said feedback suppression unit on a basis of an estimated power.

9. The hearing aid according to claim 8, wherein said controller is configured to take the first transfer function as a basis for extrapolating the second transfer function in the second section.

10. The hearing aid according to claim 9, wherein said controller is configured to determine the power of the second section of the feedback signal by means of the second transfer function.

11. The hearing aid according to claim 8, wherein the parameter influences a gain of a signal between said acoustoelectric transducer and said electroacoustic transducer in said signal processing device.

12. The hearing aid according to claim 11, wherein said controller is configured to decrease the gain by a value proportional to the estimated power.

13. The hearing aid according to claim 8, wherein said controller is configured to estimate a respective transfer function in at least two of a plurality of disjunct or only partially overlapping frequency ranges, to estimate a power of a remaining feedback signal and to adjust the parameter of said signal processing device on the basis of the estimated power.

14. The hearing aid according to claim 8, wherein said controller is part of said signal processing device.

* * * * *